US006789475B2

(12) United States Patent
Hesterman

(10) Patent No.: US 6,789,475 B2
(45) Date of Patent: Sep. 14, 2004

(54) SATELLITE PRINTING MACHINE FOR PRINTING SHEETS

(76) Inventor: Ebe Hesterman, Curiestraat 7, NL-1171 BG Badhoevedorp (NL)

( * ) Notice: Subject to any disclaimer, the term of this patent is extended or adjusted under 35 U.S.C. 154(b) by 0 days.

(21) Appl. No.: 10/740,407

(22) Filed: Dec. 22, 2003

(65) Prior Publication Data

US 2004/0129154 A1 Jul. 8, 2004

Related U.S. Application Data

(63) Continuation of application No. 09/890,506, filed as application No. PCT/EP00/12127 on Dec. 1, 2000, now abandoned.

(30) Foreign Application Priority Data

Dec. 3, 1999 (DE) ..... 299 21 184

(51) Int. Cl.[7] ..... B41F 1/00

(52) U.S. Cl. ..... 101/183; 101/178; 101/179; 101/180; 101/181; 101/219; 101/220; 101/221; 101/225; 101/229; 101/174; 101/231; 101/492; 101/171

(58) Field of Search ..... 101/178–80, 181, 101/219–221, 225, 229, 183, 174, 231, 492, 171

(56) References Cited

U.S. PATENT DOCUMENTS

| | | | | | |
|---|---|---|---|---|---|
| 4,633,777 | A | * | 1/1987 | Germann | 101/177 |
| 4,854,232 | A | * | 8/1989 | Oda | 101/211 |
| 4,934,265 | A | * | 6/1990 | Knauer | 101/177 |
| 5,036,763 | A | * | 8/1991 | Germann | 101/137 |
| 5,062,360 | A | * | 11/1991 | Germann et al. | 101/152 |
| 5,136,942 | A | * | 8/1992 | Germann | 101/177 |
| 5,660,108 | A | * | 8/1997 | Pensavecchia | 101/137 |
| 5,771,804 | A | * | 6/1998 | Knauer et al. | 101/183 |
| 5,907,997 | A | * | 6/1999 | Jackson et al. | 101/180 |
| 6,145,435 | A | * | 11/2000 | Richards | 101/180 |

* cited by examiner

*Primary Examiner*—Andrew H. Hirshfeld
*Assistant Examiner*—Andrea H. Evans
(74) *Attorney, Agent, or Firm*—Paul Vincent

(57) ABSTRACT

A satellite printing machine for printing sheets includes a single central common counter-pressure cylinder and at least four satellite printing groups arranged in a peripherally distributed manner about the counter-pressure cylinder in a rotational direction thereof from a feed cylinder to an output cylinder. The counter-pressure cylinder is provided in the form of a rubber blanket cylinder. At least one additional satellite printing group cooperates with the counter-pressure cylinder for at least single-color back side printing, and is disposed in the rotational direction of the counter-pressure cylinder before the feed system and after the output cylinder.

20 Claims, 5 Drawing Sheets

SATELLITE PRINTING MACHINE FOR PRINTING SHEETS

This application is a continuation of Ser. No. 09/890,506 having a 371(c) date of Jan. 11, 2002 now abandoned as the national stage of PCT/EP00/12127 PCT filed on Dec. 1, 2000 and claiming Paris Convention priority of DE 299 21 184.3 filed on Dec. 03, 1999 the entire enclosures of which are all hereby incorporated by reference.

BACKGROUND OF THE INVENTION

This invention relates to a single station single satellite offset printing machine for printing both sides of a sheet, in accordance with the independent claims.

Single station single satellite sheet fed printing machines have one common central counter-pressure cylinder around which printing groups are arranged in a "satellite" configuration. The common counter-pressure cylinder is therefore the "sun" of the satellite system. It is conventionally made of thick-walled steel with a hard chromium-plated surface to prevent the ink from offsetting. During printing, 4 colors can be offset or transferred onto one side of the sheet, one immediately after the other, using one single gripper bite during one printing cycle. The gripper system remains closed during the printing process enabling high register precision and a maximum of substrate flexibility.

In conventional offset satellite printing machines (DE 43 03 796 A 1 and U.S. Pat. No. 6,438,352 FIG. 4), the number of rubber and plate cylinder pairs surrounding the common counter pressure cylinder is limited to four for reasons of accessibility to the printing groups and two sequential printing stations must be provided for front and back side printing in two printing cycles, in addition to an intermediate turning or reversing system (see for example U.S. Pat. No. 5,660,108 and DE 43 59 02) and requiring multiple gripper bites (openings and closures). However, multiple gripper bites and/or turning of sheet limit the substrate flexibility and production speed. Prior Art (e.g. U.S. Pat. Nos. 6,438,352 and 5,552,875) also discloses front and back side printing via skipped (interrupted) feeding with the disadvantage of reduced printing speeds.

U.S. Pat. No. 4,493,25 discloses a multi-station printing press in which a plurality of modular printing stations are joined together. Printing on both sides of the sheet requires at least one dual printing station with two blanket carrying cylinders acting, at the same time, as a counter pressure cylinder. During the printing process, the gripper systems open and close during passage through a single station. This multi-station configuration requires an expensive machine with a very large length and height resulting in substantial costs for both for the printing press and the surrounding building. Short setup times are accordingly important. This type of modular configuration is not suited for small runs.

The double sheet fed satellite configuration of U.S. Pat. No. 5,036,763 has multiple counter-pressure cylinders requiring multiple gripper bites. The double satellite arrangement has a very large foot print and is expensive and therefore not suited for small runs and/or for downstream processing.

Due to the requirements of production on demand, 80% of future printing jobs are expected to less than 5000 sheets and will have to be delivered within a few of days, including post-press processing.

In view of this prior art and of future market considerations, it is the underlying object of the invention to introduce a single station single satellite offset printing machine for printing sheets with a maximum of substrate flexibility which enables multiple front side printing and at least a single color back side printing in only one printing cycle without an additional turning, transportation, and/or intermediate drying, which is operable with short setup service times, and which is of compact design, having a minimum number of parts and requiring only modest investment.

SUMMARY OF THE INVENTION

The invention achieves this object with a single station single satellite offset printing machine having the features of the independent claims. Other important embodiments of the invention are the subject of the dependent claims.

The inventive single station single satellite printing machine has a single common central counter-pressure cylinder which is structured as a rubber blanket cylinder and which has an associated feed system and a number of at least four to ten satellite printing groups for first side printing disposed, seen in the rotational direction of the common counter-pressure cylinder, between the feed system and the output system and with at least one additional satellite printing group for back side printing disposed, as seen in the rotational direction of the common counter-pressure cylinder, after the output cylinder and before the feed cylinder. This machine design enables multicolor front side printing and at least single-color back side printing on sheet-like printing stock, which can be printed in a single run, without additional gripper bites as are necessary with additional transfer or turning devices. There is only one common counter-pressure cylinder and no need for auxiliary cylinders or a second counter-pressure cylinder. The common counter-pressure cylinder in accordance with the invention is therefore a multiple function cylinder, since it assumes the functions of a counter-pressure cylinder, a rubber blanket cylinder, and a transportation cylinder with gripper systems.

The compact design single station single of the satellite printing machine enables a printing operation even under continuous printing stock feed conditions, which, after the proper feed-in, passes the respective satellite printing groups in accordance with the register setting. Sheet transfer problems and additional gripper functions and feed components are avoided by using only a single gripper bite. For this reason, the inventive satellite printing machine has a high repetition rate for sheet printing and can operate at full printing speed, while enabling high printing quality and rapid setup time. This configuration enables full-size printing of both the front and back side page of the sheet, and only one bordering strip is required for the gripper bite, which cannot be accessed by the printing surface about the plate cylinder. Consequently, waste of paper is considerably reduced. The satellite printing machine with its single gripper bite is particularly suited for printing stock which is difficult to handle, such as card board, multi-layer packaging, etc.

In an advantageous embodiment, each plate and rubber blanket cylinder group of the machine constitutes a cassette-shaped modular unit, which is moveable from an operating position into a service position in a direction towards the operating side or towards the drive side. In spite of the highly packed sequence in which the satellite printing groups are arranged, a quick adjustment to new printing conditions, such as new printing plates, images or rubber blankets, is possible, with good accessibility and simplification of the associated tasks.

Adjustments to the printing groups can be performed in the service position, even while the production processes are running.

The following description and drawings provide additional details and advantageous characteristics of the invention, which are illustrated in an example of the inventive satellite printing machine.

DESCRIPTION OF THE PREFERRED EMBODIMENT

Figure 1:
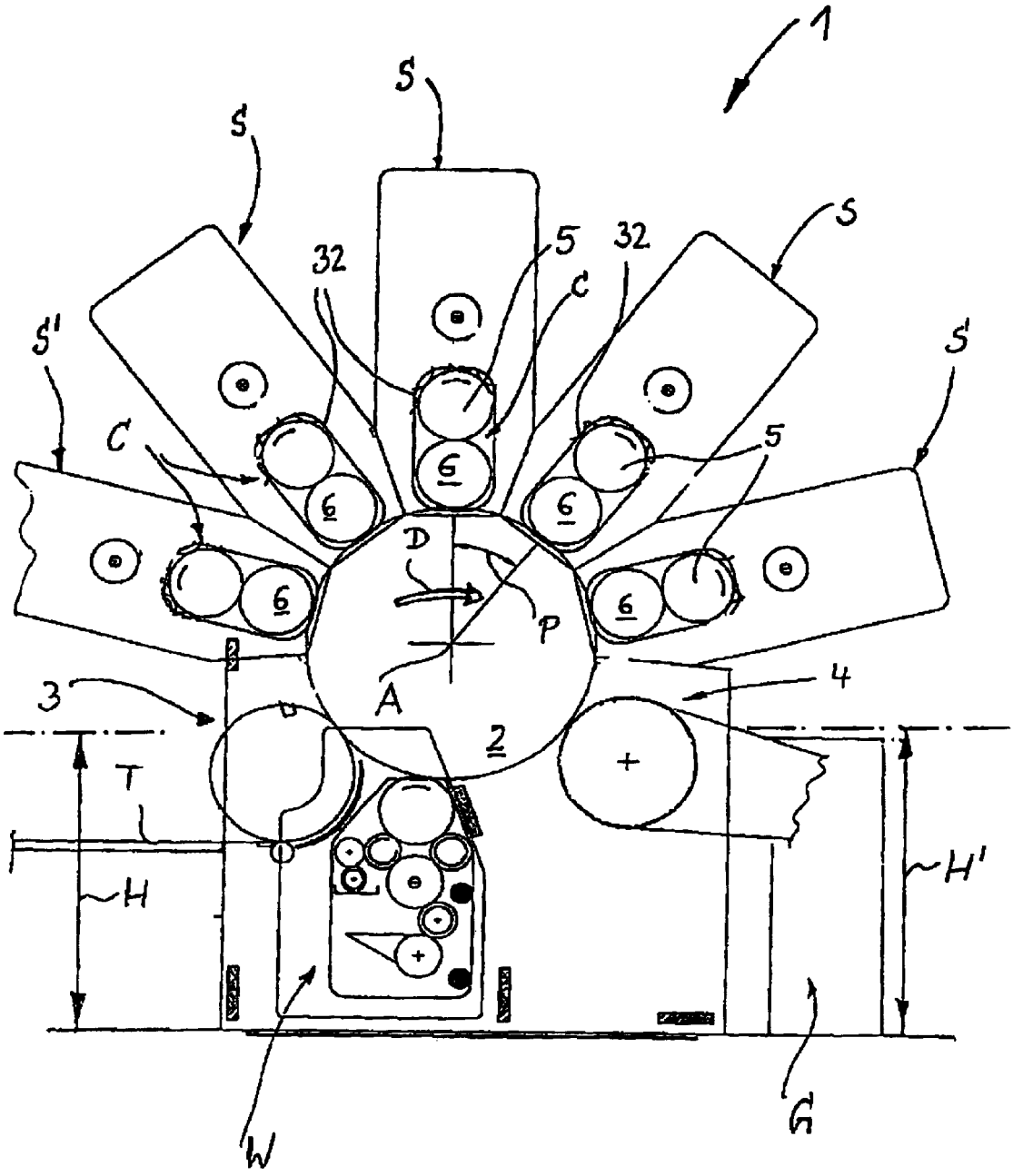
FIG. 1 shows a side view of the inventive single station single satellite sheet fed printing machine with satellite printing groups peripherally distributed around the common central counter pressure cylinder, which constitutes the "sun" of this satellite configuration.

FIG. 1 shows a single station single satellite printing machine, designated in its totality with 1, comprising a single common central counter-pressure cylinder 2, having more than four (i.e. five as shown in the figure) satellite printing groups S, S' disposed, as seen in the rotational direction D, between a feed cylinder 3 (including schematic illustration of one tension channel for a gripper system) which is provided as part of a feed system, and an output system 4 having, for example, an output cylinder and/or a chain delivery with gripper systems.

The inventive design of the satellite printing machine 1 has a counter-pressure cylinder 2 which is structured as a rubber cylinder. An additional satellite printing group W for at least single-color back side printing cooperates with the cylinder 2 and is disposed, as seen in the rotational direction D, after of the output system 4 and before the feed cylinder 3. When processing sheets as printing stock, the feed cylinder 3 and the output system 4 have gripper systems comprising conventional tension elements and tension channels. In addition, an alignment table T is disposed before the feed cylinder 3, and is adjustable during operation in the transverse direction, vertically and/or in a direction which slants relative to the direction of feed.

Each satellite printing group S comprises a plate cylinder 5 and a rubber sheet cylinder 6 which are each part of a cassette-shaped modular unit C within the satellite printing group S. After lifting its rubber cylinder 6 which is disposed adjacent to its respective printing position (FIG. 2) at the counter-pressure cylinder, each cassette unit C can be moved into a service position, without having to tilt the cassette. This increases the long-term stability of the cassette units C, and enables low-vibration printing to eliminate printing distortions.

Figure 5:
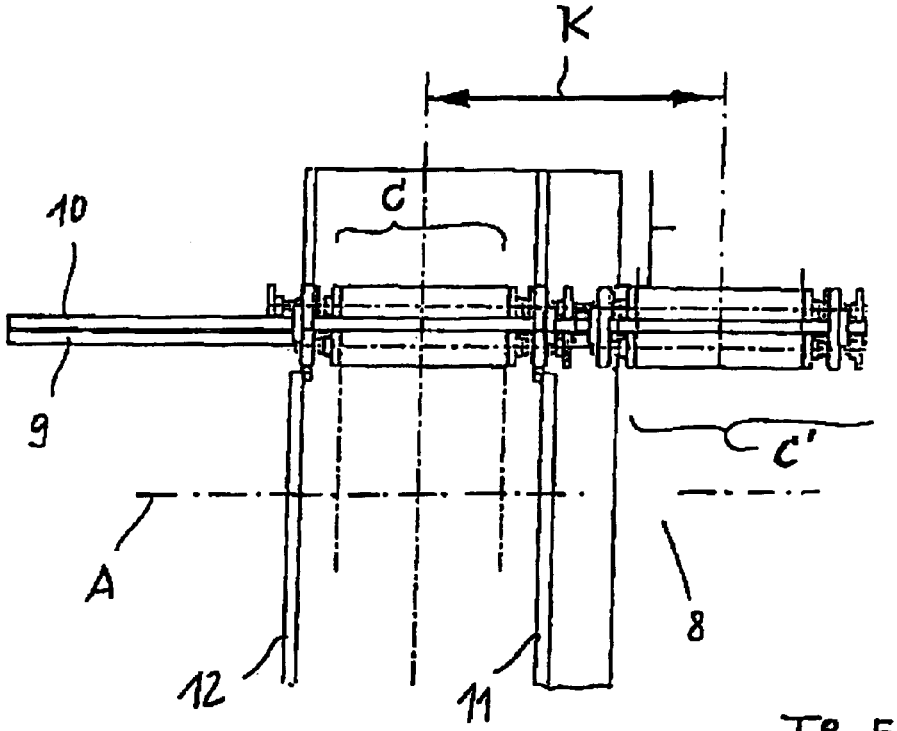
FIG. 5 shows a detail of the machine in the area of a satellite printing group during operating and following lateral displacement into service position.

The individual illustration of one of the cassette units C in FIG. 5, shows their position relative to the machine frame which generally is designated with 8. The central portion of the figure shows the cassette unit C within the machine frame 8 and the right side of the picture illustrates the cassette unit, now is designated as C', moved into a lateral service position outside of and adjacent to the machine frame 8 (arrow K, FIG. 5).

With this inventive concept of the satellite printing machine 1, up to ten indirect satellite printing groups S can be assigned to the common counter-pressure cylinder 2 for front side printing, and up to ten direct satellite printing groups W for indirect back side printing, which may be placed immediately adjacent to each other in compact design. This concept permits full-size and double-sided printing of sheets using one single gripper bite in which the gripper system only requires a small border strip of the sheet for the single gripper action to thereby advantageously reduce paper waste. The sheet is positively held from the beginning to the end of the printing process, without the sheet being removed from the common counter pressure cylinder.

In a preferred embodiment, the common counter-pressure cylinder 2 has a periphery of 500 to 3,000 mm, and the five satellite printing groups S for front side printing may be so arranged in the area of the upper arc of the counter-pressure cylinder 2, that a central angle spacing P of 35° to 45°, preferably 38°, is formed between the central planes of neighboring satellite printing groups S (FIG. 1).

In the above-described configuration of the satellite printing groups S, one of the printing groups W for back side printing is disposed in a peripheral area of the common counter-pressure cylinder 2 which is located opposite to the printing groups S. The back side printing can take place in the area between the feed cylinder 3 and, as seen in the peripheral direction D of the counter-pressure cylinder 2, the satellite printing group S'. Front and back side printing can also be done simultaneously in the area of this satellite printing group S'.

Figure 2:
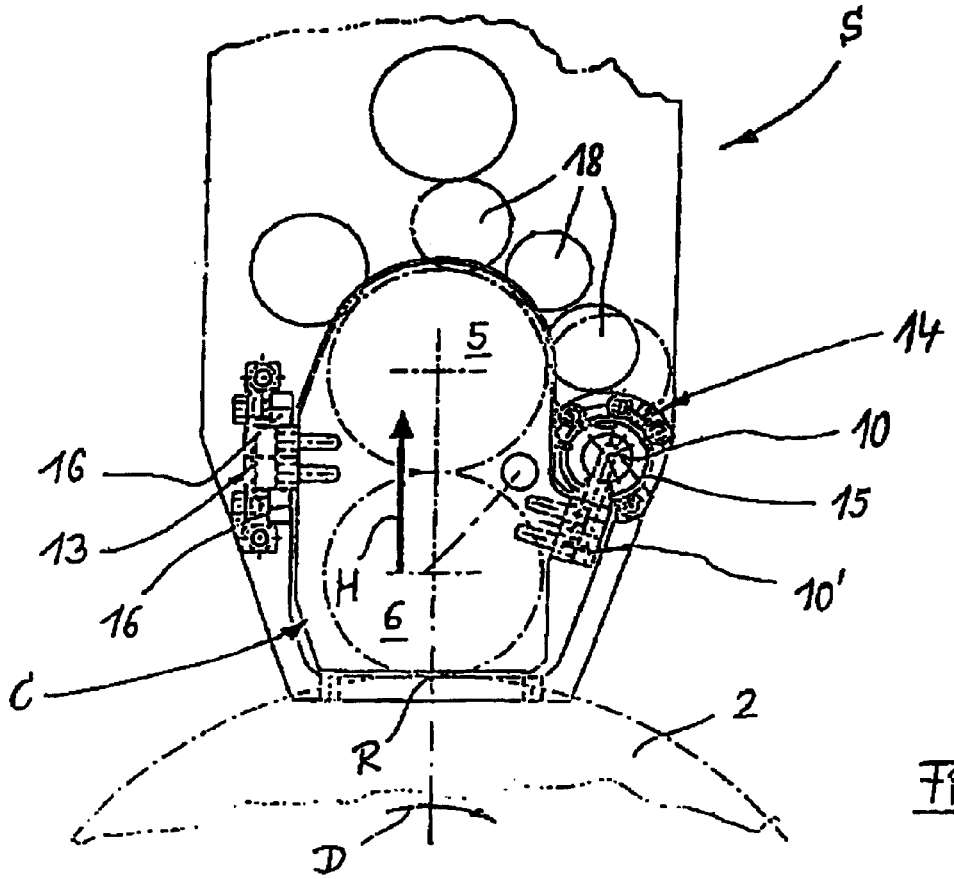
FIG. 2 shows an enlarged detail of a satellite printing group in the operating position at the common central counter-pressure cylinder.
Figure 3:
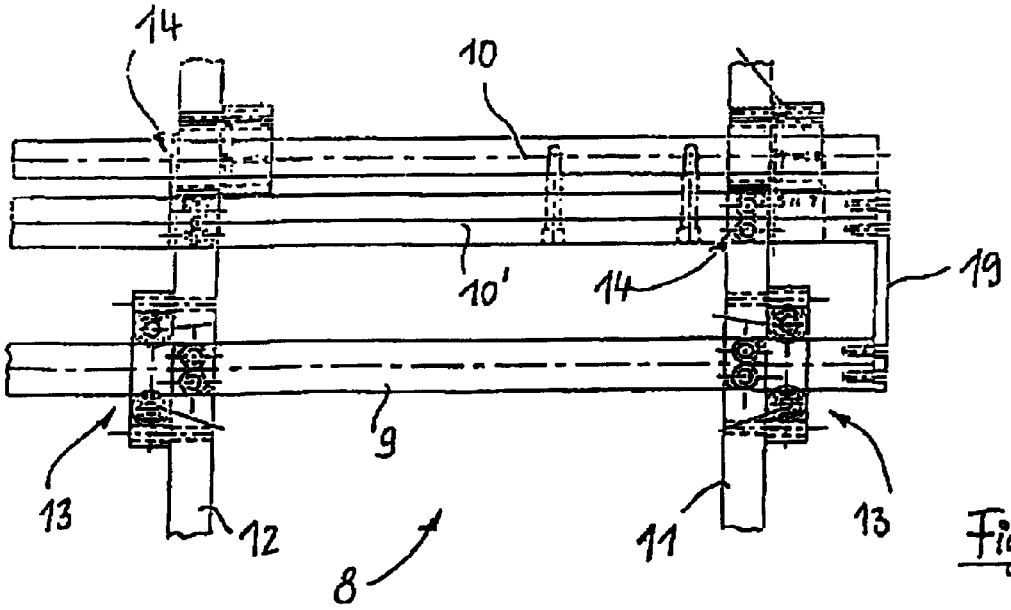
FIG. 3 shows a plan view of the device frame which supports the satellite printing group.

FIGS. 2, 3 and 5 illustrate the support of the cassette unit C, comprising the plate cylinder 5 and the rubber blanket cylinder 6 in the area of the machine frame. The cassette unit C is supported on the rails 9, 10 of its respective side supports 11, 12 of the machine frame 8. The cassette unit C can be moved parallel to these rails 9, 10 (arrow K, FIG. 5). The satellite printing group S may also be moved together with these rails 9, 10 in guides 13, 14 of the side supports 11, 12. In the embodiment shown, a linear ball bearing 15 and curved rollers 16 are provided as guides 13, 14 for the respective rails 9, 10 (FIG. 2), and the rail 10 has an underlying bar 10'. The two rails 9 and 10 are connected via a supporting strut 19 for exact positioning displacement of the cylinders 5 and 6, so that the cassette units C are displaceable into the extracted position, adjacent to the machine frame 8 (at the right-hand side in FIG. 5), and returnable in the opposite direction into the working position.

Figure 4:
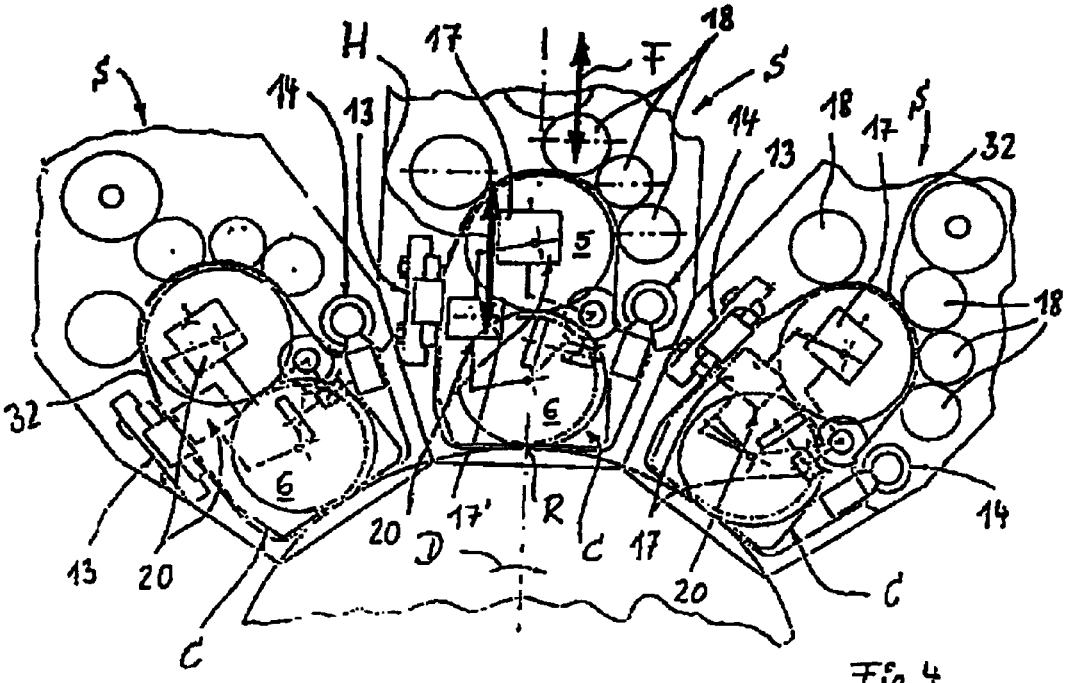
FIG. 4 shows a schematic illustration similar to FIG. 2, with several satellite printing groups in the operating position.

The enlarged illustration of the plate and rubber blanket cylinders 5, 6 according to FIG. 4 shows that each cylinder can be displaced radially within its cassette housing 32, individually one after the other as well as jointly and radially with respect to the counter-pressure cylinder 2 by means of a driving mechanism which generally is designated 20. This radial displacement enables an adjustment to the thickness of the printing stock during operation of the machine 1 without moving or correcting the register.

Figure 6:
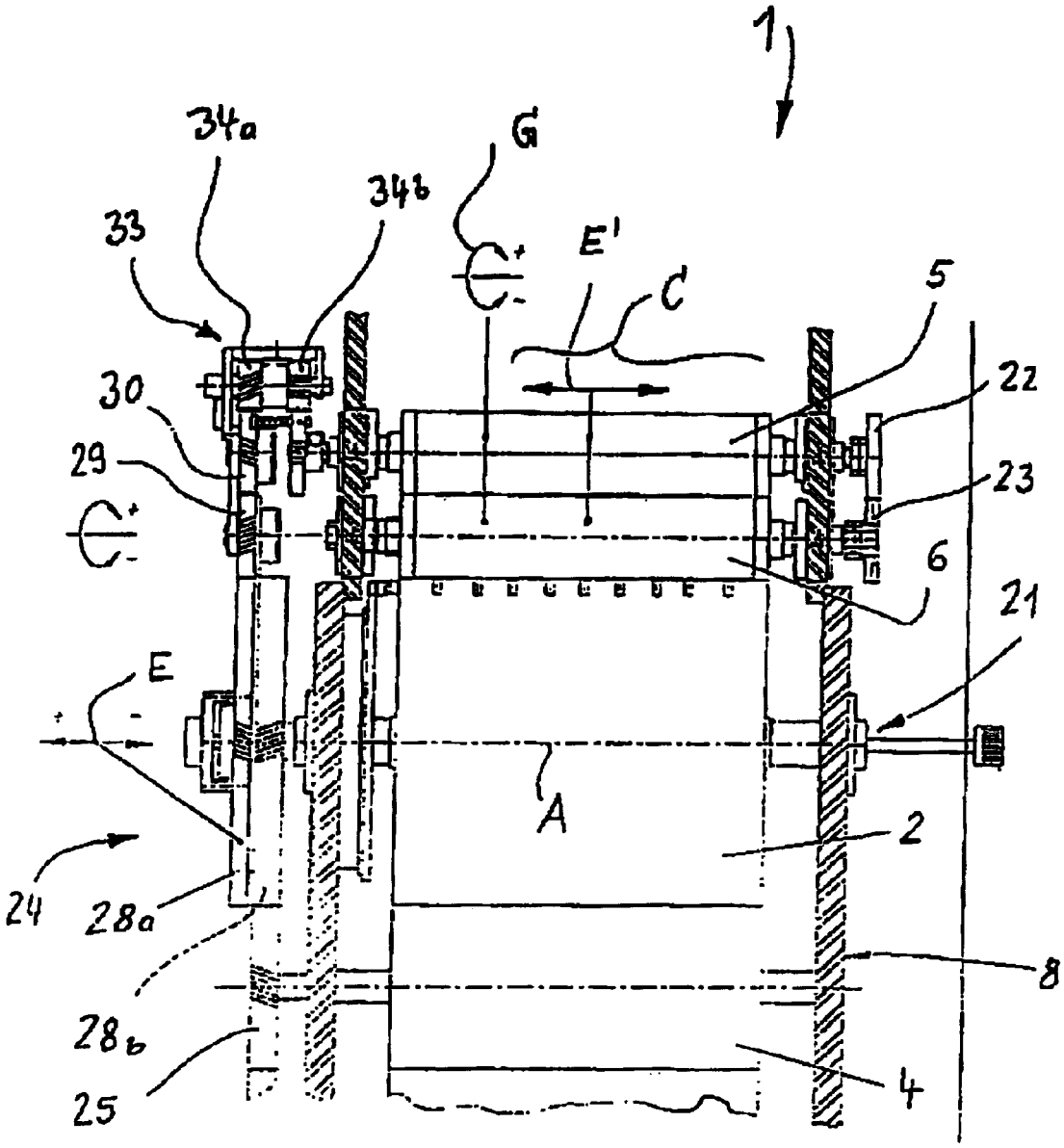
FIG. 6 shows an enlarged plan view of the machine in the area of the central counter-pressure cylinder and its gripper system and drive components.

An associated pneumatic cylinder 17 could be used as the drive means 20. During a first adjusting phase the respective inking rollers 18 must be lifted in a direction of arrow F, and, thereafter, the plate and rubber blanket cylinders 5, 6 must be displaced by pneumatic cylinders 17, 17' with a lifting motion (arrow H). The counter-pressure cylinder 2 is then free at the peripheral location R, and the cassette units C can be displaced, since the drive connection to the cylinders 5, 6 is provided by respective gear wheels 22, 23 at the side facing the direction of displacement of the cassette unit C (FIG. 6). The machine 1 may also having a servomotor drive.

FIG. 6 shows a plan view of the common counter-pressure cylinder 2 including one gripper system of nine grippers disposed across the width of the cylinder, illustrated at the separation line between the cylinder plate 6 and the counter pressure cylinder 2. The plate and rubber blanket cylinders 5, 6, are each paired together in a cassette unit C. The left side of the figure shows a toothed gear connection outside of the machine frame 8. The cylinders 5, 6 of the satellite printing groups S are in synchronous drive connection with the counter-pressure cylinder 2, and are adjustable jointly in their register position relative to the counter-pressure cylinder 2. This drive design enables an exact, joint register adjustment of the respective cylinders of all cassette units C. An adjusting means provides for said adjustment, and acts on section 28*a* of a toothed gear 21. The associated gear wheel section 28*b* is not displaceable and cooperates with a gear wheel 25 for the drive of the output system 4, which correspondingly remains uninfluenced by the register adjustments. This adjustment between the cylinders 5, 6 of the cassette units C can also be effected during operation of the satellite printing machine 1.

The toothed gear connection 24 in accordance with FIG. 6 has gear wheel sections 28*a*, 28*b*, 29, 30. Gear wheel section 28*a* can be adjusted by means of an adjusting unit 21 in the direction of the axis A (arrow E). As a result, the gear wheels 29, 30 experience a torque. In the embodiment illustrated, the gear wheel 28 cooperates to a double gear wheel 33 via the gear wheels 29 and 30, the slanted teeth gear wheel section 34*a* of which is coupled to a straight-toothed gear wheel section 34*b*. The cassette unit C can be displaced laterally (arrow E') by means of said gear wheel section 34*b*, so that a circumferential register adjustment (arrow G) and a lateral adjustment can be effected for the plate and rubber blanket cylinders 5, 6.

Figure 7:
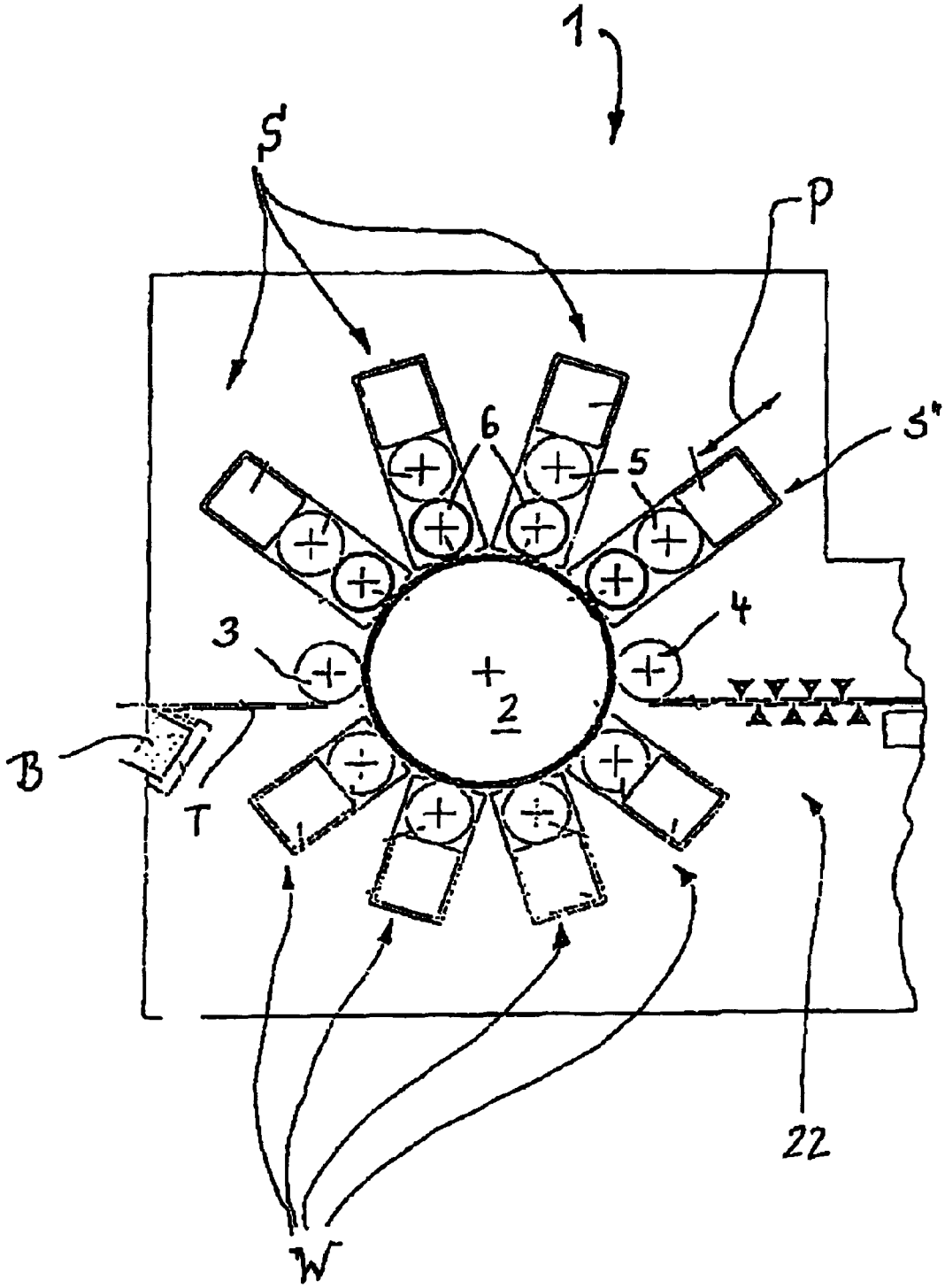
FIG. 7 shows a schematic illustration of the inventive satellite printing machine with four front side and four back side printing groups.

The schematic illustration of the satellite printing machine 1 according to FIG. 7, shows the preferred application thereof for sheets B as printing stock, which can be grasped in the area of the feed cylinder 3. The cylinder 3 and the output system 4 each can have a gripper system cooperating with the grippers systems of the common counter impression cylinder 2, as illustrated in FIG. 6. In addition, an alignment table T is provided in front of the feed cylinder 3, which is adjustable in the transverse direction, in height, in the direction of feed, and/or at a diagonal with respect to the direction of feed. Adjusting means may also be provided on the aligning table T to effect the changes in the direction of feed of the printing stock described above. These adjustments may also be made during operation of the satellite printing machine 1. The aligning table is provided with vacuum conveyor belts disposed in a respective format-dependent geometry to minimize loss of energy.

In one advantageous embodiment for operating the machine 1, the feed system 3 and the output system 4 are disposed at an essentially equal height (H, H' in FIG. 1) via a supporting plane, thus defining an approximate horizontal operating plane. Additional devices G can be provided for further downstream processing in the area of the output system 4, so that the printing stock is conveyed in a conveyer line for the purpose of coating, drying, etc. These heights H and H' also enable a simple loading and unloading of the machine 1 from the floor.

The inventive design of the satellite printing machine comprises modular units by means of which one of the satellite printing group S for front printing, preferably as viewed in the rotational direction, the last satellite printing group S" (FIG. 7) can be displaced as a unit into a service position according, as indicated by the arrow P. In this service position, the satellite printing group S" can be replaced with a printing group for a different printing process, such as flexo or silk-screen printing. The printing groups for front and back side printing are arranged one after the other.

The machine 1 is designed to permit combinations of any printing groups. The machine may thereby comprise flatbed and/or rotogravure and/or letterpress and/or silk-screen and/or xerographic and/or ink jet printing systems.

I claim:

1. A single station single satellite offset printing machine for printing a sheet in compact design, the machine comprising:

a single, central multiple function cylinder, said multiple function cylinder structured as common a counter-pressure cylinder, an intermediate transfer cylinder and a sheet transportation cylinder;

a feed system engaging said multiple function cylinder at an input side thereof;

an output system engaging said multiple function cylinder at an output side thereof substantially opposite to said input side;

at least four satellite printing groups for front side printing which are disposed about said multiple function cylinder, as seen in a rotational direction thereof, between said feed system and said output system, each of said at least four satellite printing groups having an image plate carrying cylinder and a blanket carrying intermediate transfer cylinder;

at least one additional satellite printing group for at least single-color back side printing disposed, as seen in the rotational direction of said multiple function cylinder, after said output system and before said feed system, said at least one additional satellite printing group including at least one image plate carrying cylinder for transferring ink to said multiple function cylinder; and at least one gripper system disposed on said multiple function cylinder to grasp the sheet for printing of all printing groups, on both the front and back sides of the sheet, with only one single gripper bite and in only one printing cycle, wherein the gripper system remains closed until completion of the printing process on both sides of the sheet.

2. The satellite printing machine of claim 1, wherein said at least four satellite printing groups comprise up to ten satellite printing groups for said front side printing, and said at least one additional satellite printing group comprises up to ten satellite printing groups for said back side printing.

3. The satellite printing machine of claim 1, wherein said at least four satellite groups comprise five satellite printing groups arranged along an upper arc of a circumference of said multiple function cylinder, said five satellite printing groups being mutually spaced with respect to each other at angular intervals of 35° to 45°.

4. The satellite printing machine of claim 1, wherein said back side printing is effected by a transfer of ink in an area between said feed system and, as seen in the rotational direction of said multiple function cylinder, a downstream first one of said at least four satellite printing groups.

5. The satellite printing machine of claim 1, wherein said front and said back side printing occur simultaneously in an area of said at least four satellite printing groups which, as seen in the direction of rotation of the said multiple function cylinder, downstream of the feed system.

6. The satellite printing machine of claim 1, wherein said image plate carrying and blanket carrying cylinders of said at least four satellite printing groups are in synchronous drive connection with said multiple function cylinder and are jointly adjustable in peripheral alignment relative to said multiple function cylinder.

7. The satellite printing machine of claim 1, wherein the machine is structured for printing at full speed in one cycle on both sides of the sheet.

8. The satellite printing machine of claim 1, wherein the machine is structured for printing in full size in one cycle on both sides of the sheet.

9. The satellite printing machine of claim 1, wherein said multiple function cylinder comprises a slanted gear wheel, and said image plate carrying and blanket carrying cylinders of said at least four satellite printing groups are driven by slanted gear wheels which mesh with said slanted gear wheel of said multiple function cylinder, wherein said slanted gear wheel is subdivided to form a gear wheel section which meshes with a remaining section of the slanted gear wheel, said multiple function cylinder and said gear wheel section being movable in a direction of an axis thereof.

10. The satellite printing machine of claim 1, wherein said multiple function cylinder comprises a slanted gear wheel, and said image plate carrying and blanket carrying cylinders of said at least four satellite printing groups are driven by slanted gear wheels which mesh with said slanted gear wheel of said multiple function cylinder, wherein said slanted gear wheel is subdivided to form a gear wheel section which meshes with a remaining section of the slanted gear wheel, said multiple function cylinder and said gear wheel section being movable in a direction of an axis thereof.

11. The satellite printing machine of claim 1, wherein said feed system and said output system are disposed at essentially a same height above a base plane of the machine and define an approximately horizontal operating level to facilitate downstream processing.

12. The satellite printing machine of claim 1, wherein printing groups for both said front and back side printing are arranged one after the other for printing in one cycle, without intermediate drying, transportation, and/or turning.

13. The satellite printing machine of claim 4, wherein said angular distance is about 38°.

14. The satellite printing machine of claim 1, wherein the front and back side printing process is effected in one cycle without the sheet being removed from the said multiple function cylinder.

15. The satellite printing machine of claim 1, wherein front and back side printing groups are engaged by said multiple function cylinder in only one satellite configuration.

16. A single station single satellite printing machine for printing sheets on front and back sides thereof, the machine comprising:

a feed system;

an output system;

a central common counter-pressure cylinder disposed between said feed system and said output system;

a first satellite printing group set including at least four satellite printing groups for printing directly onto the front side of the sheets, said first set of satellite printing groups being cooperative with said common central counter-pressure cylinder and arranged along a first arcuate portion of said central counter-pressure cylinder extending in a rotational direction thereof from the feed system to the output system; and a second satellite printing group set including at least one satellite printing group for printing at least a single-color on the back side of the sheets, said second set of printing groups being cooperative with said central counter-pressure cylinder and arranged along a second arcuate portion of said central counter-pressure cylinder extending in a rotational direction thereof from the output system to the feed system, said at least one satellite printing group being operable to deposit ink onto said central counter-pressure cylinder, the ink then being offset or transferred by means of a blanket therefrom to the back side of the sheets while transferred over said first arcuate portion of said central counter-pressure cylinder, wherein a gripper system remains closed until completion of the printing process on both sides of the sheet.

17. The satellite printing machine of claim 16, wherein each of said at least four satellite printing groups includes an image plate carrying cylinder and a blanket carrying cylinder and each of said at least one satellite printing group includes at least one image plate carrying cylinder, said common counter-pressure cylinder including at least one blanket carried theron.

18. The satellite printing machine of claim 1, wherein each of said at least four satellite printing groups includes an image plate carrying cylinder and a blanket carrying cylinder and each of said at least one satellite printing group includes at least one image plate carrying cylinder, said common counter-pressure cylinder including at least one blanket carried theron.

19. The satellite printing machine of claim 16, wherein at least one of said first and second satellite printing groups are exchangeable for at least one of flatbed, rotogravure, letterpress, silk-screen, xerographic and ink jet printing.

20. The satellite printing machine of claim 1, wherein at least one of said first and second satellite printing groups are exchangeable for at least one of flatbed, rotogravure, letterpress, silk-screen, xerographic and ink jet printing.

* * * * *